United States Patent [19]

Knock

[11] 4,213,490

[45] Jul. 22, 1980

[54] INSULATION GUN

[76] Inventor: Harry A. Knock, 388 Marvin Pl., Wheeling, Ill. 60090

[21] Appl. No.: 963,823

[22] Filed: Nov. 27, 1978

[51] Int. Cl.[2] ..... B65B 1/04

[52] U.S. Cl. ..... 141/311 R; 141/392

[58] Field of Search ..... 141/1, 311 R, 392; 184/105 A; 222/137, 244, 246; 417/900, 430

[56] References Cited

U.S. PATENT DOCUMENTS

| | | | |
|---|---|---|---|
| 1,620,824 | 3/1927 | Manzel | 141/311 R |
| 2,755,968 | 7/1956 | Fiant | 141/392 X |
| 2,831,606 | 4/1958 | Alters | 222/246 X |

*Primary Examiner*—Frederick R. Schmidt

*Attorney, Agent, or Firm*—Kenneth R. Glaser

[57] ABSTRACT

A manually operated insulation gun for injecting particulated insulation into a confined wall space is disclosed. The insulation gun includes a tubular housing for receiving a load of particulated insulation material and a piston slidably disposed within the housing for ejecting the insulation material. The piston is manually operated by means of a piston rod attached to the piston and which projects through a closed end of the housing. A plunger is coupled to the piston and the closed end of the housing for breaking up compacted accumulations of the insulation material. A fill nozzle is connected to the discharge opening of the tubular housing for directing the flow of insulation material into the wall space. The fill nozzle is preferably slightly tapered which causes the insulation particles to travel in swirling, turbulent movement as they are discharged into the wall space, thereby promoting the uniform distribution of insulation within the wall space and also promoting expansion of compacted nodules of material to minimize the insulation density.

2 Claims, 6 Drawing Figures

FIG. 1
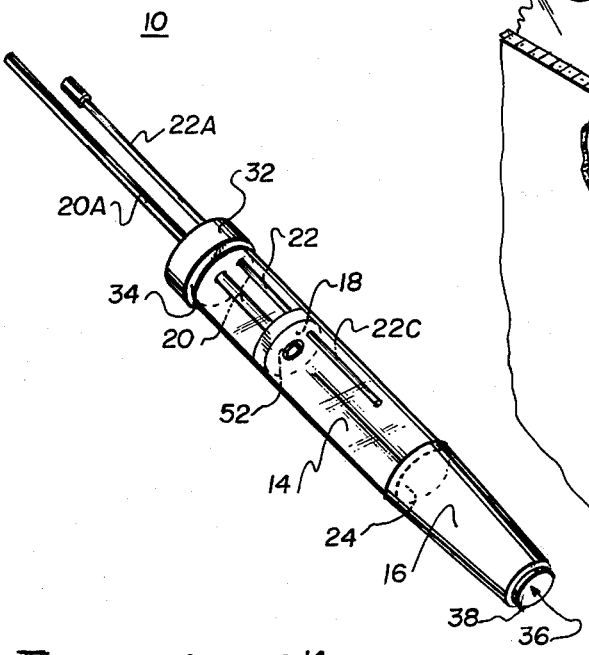
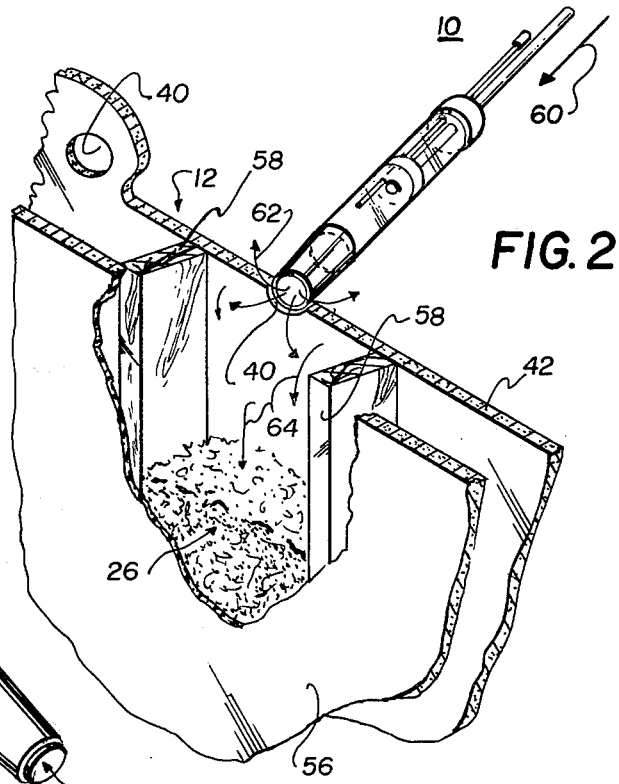
FIG. 2
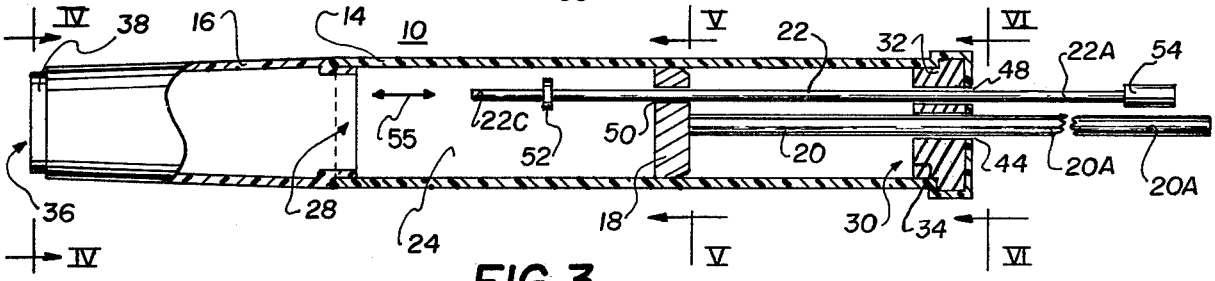
FIG. 3
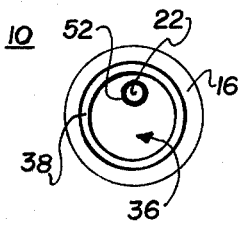
FIG. 4
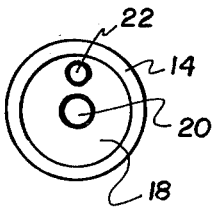
FIG. 5
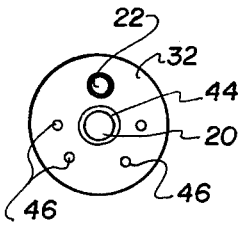
FIG. 6

INSULATION GUN

BACKGROUND OF THE INVENTION

1. Field of the Invention

The present invention relates to apparatus for injecting particulated material into a hollow enclosure and in particular to a manually operated gun for injecting particulated or comminuted insulation material into a confined wall space.

2. Description of the Prior Art

Because of the rapidly rising costs of energy, the incentives to conserve energy are increasing, especially for domestic users. The potential for energy conservation in the home is substantial because of the amount of energy required to operate home heating and cooling systems. Significant energy loss is substained in older dwellings because of heat gain and heat loss by conduction of thermal energy through uninsulated walls.

A well known and efficient method for insulating wall spaces, such as the wall spaces defined by the studding, inner lathing and outer sheathing of frame buildings, is carried out by filling the spaces with an insulating material conveyed in an air stream. Insulating materials such as mineral or rock wool in granular form are now used extensively as an insulating medium in building construction and particularly in older buildings which require insulation, because such materials may be readily blown into the spaces in old walls and into other remote places by suitable equipment developed for that purpose. Non-mineral insulating materials such as shredded cellulose products also may be injected in the same manner. All of these materials belong to a class of "loose fill" insulating materials such as granulated rock wool, granulated mineral fiber wools, glass fiber materials, cellulose fiber materials, expanded mica, etc.

This so called "loose fill" insulating material is usually packed under compaction in bags or bails. The containers are opened and the material is dumped into a hopper for feeding into an air line for delivery to the area to be insulated. The material is very light in weight, being composed of low density nodules which have been somewhat compressed in the package. The individual nodules should be separated from one another and allowed to expand to full size before placement in a wall. The very nature of the material makes feeding difficult, and the material is very susceptible to compression and compaction, making uniform distribution of the insulation throughout the wall space very difficult to achieve. This results in loss of bulk for filling and an increase in density in the insulated area, leading to increased costs for material and reduction in dead air space in the wall. Further, delivery of the particulated insulation in an air stream is a continuous process which will cause a large amount of insulation material to be wasted by the escape of fugitive particles as the delivery conduit is moved from place to place.

Delivery of insulation by entraining the particulated insulation material in an air stream is typically a commercial operation which is relatively expensive unless carried out on a large scale such as for attic installations. In certain situations, a home owner may desire to insulate a number of wall spaces in a dwelling for which the conventional forced air insulation blowing technique cannot be justified economically or because the wall spaces cannot be reached by the conventional forced air equipment.

SUMMARY OF THE INVENTION

Accordingly, the instant invention is concerned with and has for its principal object the provision of a manually operated insulation gun which does not require the use of forced air for delivery of particulated insulation material.

It is another object of the invention to provide apparatus for manually injecting particulated insulation material into a confined wall space in a controllable manner.

It is another object of the invention to provide an improved insulation gun for having a minimum of moving parts and a manually operated ejection system for delivering loose fill insulation material of uniform density at a controlled rate through a cylindrical applicator.

It is yet another object of the present invention to provide manually operated feeding apparatus that will feed particulated material uniformly in expanded form with the particles separated so that a maximum bulk, even density deposit can be made within a confined space.

These and other objects and advantages are accomplished in accordance with the present invention by a hand operated insulation gun in which particulated insulation material is forced through a tubular chamber and a discharge nozzle in response to the manual displacement of a piston through the chamber. Swirling and turbulent movement of the particles is provided by the tapered structure of the nozzle which permits compacted nodules of insulation to be separated from one another and allowed to expand to full size while being dispersed uniformly in a confined wall space. A manually operated plunger is coupled in sliding engagement with the piston and housing for breaking up compacted accumulations of particulated insulation material.

The foregoing and other objects, advantages and features of the invention will hereinafter appear, and for purposes of illustration, but not of limitation, an exemplary embodiment of the subject invention is shown in the appended drawings.

BRIEF DESCRIPTION OF THE DRAWINGS

FIG. 1 is a perspective view of an insulation gun constructed according to the teachings of the present invention;

FIG. 2 is a perspective view, partly in section and partly broken away, of a wall space being filled by the insulation gun shown in FIG. 1;

FIG. 3 is an elevation view, partly in section, of the insulation gun shown in FIG. 1;

FIG. 4 is a view taken along the lines IV—IV of FIG. 3;

FIG. 5 is a sectional view taken along the lines V—V of FIG. 3; and

FIG. 6 is a sectional view taken along the lines VI—VI of FIG. 3.

DETAILED DESCRIPTION OF THE PREFERRED EMBODIMENT

In the description which follows, like parts are marked throughout the specification and drawings with the same reference numerals, respectively. The drawing figures are not necessarily to scale and in some instances portions have been exaggerated in order to more clearly depict certain features of the invention.

With particular reference to FIG. 1, a manually operated insulation gun constructed according to the teachings of the invention is illustrated and is designated generally by the reference numeral 10. The purpose of the insulating gun 10 is to controllably deliver particulate insulation material into the interior of a wall space 12 as shown in FIG. 2 of the drawing. The principal components of the insulation gun 10 are a tubular housing 14, a fill nozzle 16, a piston 18, a piston rod 20 and a plunger 22. The tubular housing 14 is preferably an elongated cylinder of a transparent plastic material which encloses a loading chamber 24 for receiving a charge of particulated insulation material 26 (FIG. 2).

The insulation material 26 is hand loaded into the loading chamber 24 through a discharge opening 28. The discharge opening 28 is made accessible by removing the fill nozzle 16. The fill nozzle 16 preferably engages the discharge opening 28 in a "snap in" compression fit to facilitate rapid installation and removal.

The opposite open end 30 of the loading chamber 24 is closed by a plug 32. The plug 32 has a recessed shoulder portion 34 which fits in registration with the portion of the tubular housing 14 which defines the open end 30. The plug 32 is preferably attached to the housing 14 by means of adhesive or a suitable fastener (not shown).

The fill nozzle 16 is slightly tapered to impart swirling and turbulent movement to the particles of insulation as they are discharged into the wall space 12. The fill nozzle 16 may be constructed of any suitable light weight material such as aluminum or plastic. The discharge port 36 of the fill nozzle 16 is circumscribed by an annular, axially projecting lip 38 for insertion into a cutout opening 40 formed in a wall 42 as shown in FIG. 2. This structural arrangement serves to stabilize the end of the insulation gun 10 and also prevents the escape of fugitive insulation particles during operation.

Referring now to FIGS. 1 and 2, the piston rod 20 is suitably connected to the piston 18 and includes a handle portion 20A which projects through an opening 44 in the plug 32. The piston 18 is displaced through the chamber in response to movement of the piston rod handle 20A by an operator. Motion of the piston 18 through the loading chamber 24 displaces particulated insulation material 26 through the discharge opening 28 and through the discharge port 36 of the fill nozzle 16 in response to extension of the piston rod 20. The plug 32 includes a number of vent openings 46 to allow the escape of trapped air behind the piston 18 as the piston and piston rod are retracted. The piston rod 20 is preferably loosely coupled in sliding relation within the opening 44 to permit unrestrained extension and retraction of the piston 18. The piston 18 is preferably chamfered to provide low resistance to retraction.

The purpose of the plunger 22 is to break up compacted accumulations of particulated insulation material which may form within the loading chamber 24. To carry out this function, the plunger 22 has a handle portion which extends through an opening 48 formed in the plug 32. The plunger 22 is provided with a tip portion 22C for penetrating and engaging the compacted accumulation of insulation material. To carry out this function, the plunger 22 is loosely coupled in sliding relation with the piston 18 and extends through an opening 50 formed therein. Retraction of the plunger is limited by means of a rib or other suitable stop 52. The plunger handle 22A is provided with a knob 54 which facilitates manipulation of the plunger by an operator. Operation of the plunger 22 to break up compacted accumulations of insulation is carried out by "churning" or rapidly reciprocating the plunger to penetrate and engage the compacted material as indicated by the arrow 55 in FIG. 3.

Referring now to FIG. 2, operation of the insulation gun 10 is carried out by engaging the lip 38 of the fill nozzle 16 in registration with the cutout fill opening 40 which has been previously prepared with a circular drill (not shown). The particulated insulation material 26 is injected into the wall space 12 which is enclosed by the structural members of a building wall including the interior wall 42, an outer wall formation 56 and horizontally spaced vertical studs 58 disposed intermediate the inner wall 42 and outer wall 56. The choice of locating the cutout fill opening 40 in the inside wall or the outside wall is an arbitrary matter of personal choice or convenience.

As the piston rod 22 is extended as indicated by the arrow 60, particulated insulation material is forced out of the discharge port 36 and into the wall space 12. Because of the taper of the fill nozzle 16, the nodules and other particles of insulation undergo a swirling, turbulent movement as they are discharged (indicated by the arrow 62). This permits small clumps or nodules of insulation particles to expand and be distributed randomly as they are discharged in various directions and then fall under the influence of gravity as indicated by the arrow 64. The swirling movement and random distribution during free fall assures that the insulation particles will expand and be distributed substantially uniformly within the enclosed wall space 12. The swirling, turbulent movement of the particles as they are discharged prevents the formation of large, compacted clumps of insulation from being formed and deposited within the wall space 12. This results in a uniform distribution of small dead air spaces throughout the wall for best insulation effect.

Although a preferred embodiment of the invention has been described in detail, it should be understood that various changes, substitutions and alterations can be made therein without departing from the spirit and scope of the invention as defined by the appended claims.

What is claimed is:

1. In combination:

(a) a confined building wall space defined by parallel wall portions and interconnecting stud means, one of said wall portions having a cutout fill opening therein;

(b) insulation gun apparatus operatively interconnected with said cutout fill opening for injecting particulated insulation material through said cutout fill opening into said confined building wall space; and (c) particulated insulation material disposed within said insulation gun apparatus;

(d) said insulation gun apparatus comprising (i) a tubular housing defining a loading chamber having a discharge opening at the forward end threreof, said particulated insulation material being disposed within said loading chamber, (ii) a piston assembly for ejecting said particulated insulation material from said loading chamber through said discharge opening, said piston assembly comprising a piston disposed for reciprocal movement within, and in the axial direction of, said loading chamber and a piston rod, including a handle portion, connected with said piston and projecting in the axial direction of said tubular housing for reciprocating said piston in response to movement of said handle portion by an operator, and (iii) a fill nozzle removably connected with said tubular housing at said discharge opening and engaging said one wall portion, said fill nozzle comprising a tapered housing defining a discharge port in communication with said loading chamber and having an annular, axially projecting lip circumscribing said discharge port and extending through said cutout fill opening, (iv) wherein said insulation gun apparatus further includes a plunger for breaking up compacted accumulations of said particulated insulation material within said loading chamber, said plunger being separate from, an parallel to, the said piston rod and slidably and transversely extending through said piston into said loading chamber for reciprocating movement in said loading chamber by an operator.

2. The combination as defined by claim 1 wherein said plunger includes stop means for limiting retraction through said piston.

* * * * *